United States Patent [19]

Schindler et al.

[11] 4,439,313

[45] Mar. 27, 1984

[54] REMOVAL OF ARSENIC IMPURITY FROM HYDROCARBONS

[75] Inventors: Harvey D. Schindler, Fairlawn; Morgan C. Sze, Portsmouth, both of N.J.

[73] Assignee: The Lummus Company, Bloomfield, N.J.

[21] Appl. No.: 332,662

[22] Filed: Dec. 21, 1981

Related U.S. Application Data

[63] Continuation-in-part of Ser. No. 213,202, Dec. 5, 1980, abandoned.

[51] Int. Cl.[3] ..... C10G 25/00; C01G 28/00; C01G 28/02; C10L 9/02

[52] U.S. Cl. ..... 208/251 H; 208/307; 423/87; 44/4; 44/5

[58] Field of Search ..... 208/251 H, 307; 44/4, 44/5; 423/87, 138, 594, 602

[56] References Cited

U.S. PATENT DOCUMENTS

| | | | |
|---|---|---|---|
| 2,867,577 | 1/1959 | Urban, Jr. et al | 208/251 H |
| 2,939,833 | 6/1960 | Wankat et al. | 208/307 |
| 2,956,004 | 3/1958 | Conn et al. | 208/251 H |
| 3,542,669 | 11/1970 | De Feo | 208/307 |
| 3,833,498 | 9/1974 | Stahfeld | 208/307 |
| 3,834,187 | 10/1974 | Vannenrosy | 208/307 |
| 3,876,533 | 4/1975 | Myers | 208/251 H |
| 3,933,624 | 1/1976 | Myers | 208/251 H |
| 3,954,603 | 5/1976 | Curtin | 208/251 H |
| 4,154,241 | 6/1979 | Simo | 208/251 H |
| 4,188,280 | 2/1980 | Jensen | 208/53 |
| 4,227,995 | 10/1980 | Sze et al. | 208/251 H |

*Primary Examiner*—Delbert E. Gantz
*Assistant Examiner*—Helane E. Maull
*Attorney, Agent, or Firm*—Elliot M. Olstein; Louis E. Marn

[57] ABSTRACT

Arsenic is removed from a hydrocarbon containing arsenic as an impurity; e.g., shale oil, by contact with hydrogen in the presence of a contact material, such as coke, to deposit the arsenic on the contact material. The arsenic deposited on the contact material is subsequently reacted with an iron compound to produce an iron-arsenic compound suitable for disposal.

10 Claims, 1 Drawing Figure

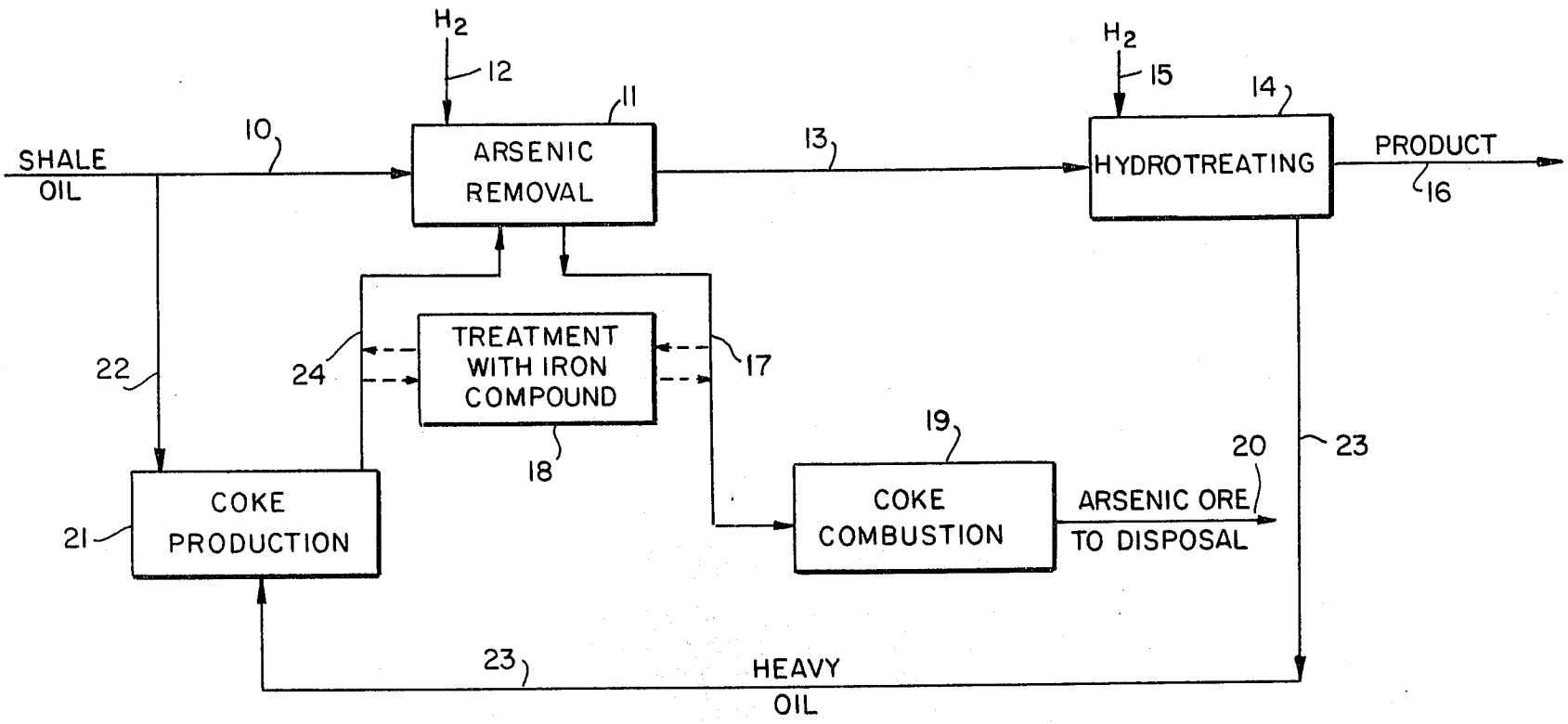
SHALE OIL
10
$H_2$
12
ARSENIC REMOVAL
11
13
$H_2$
15
HYDROTREATING
14
PRODUCT
16
TREATMENT WITH IRON COMPOUND
18
17
24
COKE PRODUCTION
21
22
COKE COMBUSTION
19
ARSENIC ORE TO DISPOSAL
20
23
HEAVY OIL
23

REMOVAL OF ARSENIC IMPURITY FROM HYDROCARBONS

This application is a continuation-in-part of U.S. application Ser. No. 213,202 filed on Dec. 5, 1980 now abandoned.

This invention relates to the treatment of hydrocarbon containing feedstocks in which arsenic is present as an impurity, and more particularly to a new and improved process for effectively removing arsenic from such feedstocks.

In the hydrotreating of hydrocarbon containing feedstocks, in which arsenic is present as an impurity, such as a shale oil, which may contain from 30 to 50 ppm of arsenic, such highly toxic arsenic constitutes a major obstacle in the commercialization of a hydrotreating process for upgrading such shale oil. In the hydrotreating of such shale oil, the arsenic impurity deposits on the hydrotreating catalyst thereby creating a potential disposal problem resulting from such deposited arsenic. Thus, for example, if there is an attempt to regenerate spent catalyst containing deposited arsenic by burning off of the carbon, volatile arsenic oxide is formed, and such arsenic oxide presents a potential health hazard. If the spent catalyst is disposed of without regeneration, arsenous sulfide present on the catalyst may not be completely inert and, in the high concentrations formed on the catalyst, would constitute a potential health hazard.

In accordance with the present invention, there is provided a process for pretreating a hydrocarbon containing feed which contains arsenic as an impurity, by contacting the feed with hydrogen in the presence of a solid contact material, with such contacting resulting in the effective removal of the arsenic impurity by deposition thereof on the contact material. The feed may then be upgraded by hydrotreating, as known in the art, without the problems heretofore encountered as a result of deposition of arsenic on the hydrotreating catalyst.

The contact material including deposited arsenic may be further treated by heating thereof in the presence of an iron compound which is capable of combining with deposited arsenic during the heating to produce an iron-arsenic compound suitable for disposal.

More particularly, the contact material, containing deposited arsenic, which is no longer to be employed in the pretreating, is heated in the presence of an iron compound, with the iron compound having been added to the contact material used for arsenic removal or added to the contact material subsequent to arsenic removal and prior to combustion, with the heating being to a temperature at which the arsenic and iron in the presence of oxygen combine to produce an iron-arsenic compound which may be disposed of without creating a potential health hazard. As representative examples of suitable iron compounds, there may be mentioned: ferrous sulfate, ferric nitrate, ferric hydroxide, ferric chloride and the like. A preferred iron compound is ferrous sulfate. The selection of a suitable compound should be apparent to those skilled in the art from the teachings herein.

During the heating, the iron and arsenic combine or react to produce one or more iron-arsenic compounds which are non-volatile, chemically stable, insoluble in water and which do not present a potential health hazard. Such compounds may be one or more of ferrous arsenide (lollingite), ferrous arsenous sulfide, or an iron-arsenate ($FeAsO_4$), all of which are naturally occurring ores, non-volatile and chemically stable. The iron-arsenic compound may then be buried with no health hazard either during handling or after disposal.

The contact material having the deposited arsenic is generally heated to temperatures in the order of at least 1200° F., generally from 1200° F. to 2000° F., (preferably 1500° to 2000° F.) and at such temperatures, the iron, in the presence of oxygen, combines with the arsenic impurity, generally present as a sulfide, to produce an iron-arsenic compound, as hereinabove described. The iron compound is preferably present in an amount which is at least stoichiometrically sufficient to react with all of the arsenic, present as an impurity deposited on the contact material; however, it is to be understood that lower amounts could be employed with the result that some amount of the arsenic may not combine with the iron. As should be apparent, the iron compound is preferably present in an amount which is at least sufficient to react with all of the arsenic deposited on the contact material. The selection of optimum amounts of the iron compound for reaction with the arsenic impurity on the contact material is deemed to be well within the scope of those skilled in the art from the teachings herein.

The feedstock which is pretreated in the presence of the contact material may be any one of a wide variety of hydrocarbon containing feedstocks which contain arsenic as an impurity, and in particular shale oils or shale oil residues. In general, the feedstocks which are pretreated and which present a disposal problem as to arsenic impurity contain at least 5 ppm of arsenic.

The pretreating of the feed by contact with hydrogen in the presence of the contact material is generally accomplished at temperatures in the order of from 500° F. to 850° F., preferably from 575° F. to 800° F., and a pressure of from 350 to 2000 psig, preferably from 500 to 2000 psig. Liquid hourly space velocities are generally in the range from 0.5 to 5.0 $hr^{-1}$, preferably from 1.0 to 3.5 $hr^{-1}$. The hydrogen is supplied in an amount sufficient to effect the arsenic removal, with such hydrogen generally being employed in an amount from 2000 to 6000, standard cubic feet per barrel, preferably from 2000 to 5000 standard cubic feet per barrel. In general, the contact material requirements for effective removal of the arsenic are in the order of from ¼ lb to 2 lbs of the contact material per bbl of feed; however, as should be apparent such amounts are dependent upon the arsenic content of the feed. The selection of optimum conditions for removal of arsenic from a particular feedstock is deemed to be within the scope of those skilled in the art from the teachings herein.

The pretreating of the feedstock may be effected in any one of a wide variety of reactors. Thus, for example, such pretreating may be effected in a fixed bed reactor, a moving bed reactor, a liquid fluidized bed reactor, an expanded bed reactor, or the like. The selection of a particular type of reaction system is deemed to be within the scope of those skilled in the art from the teachings herein.

The contact material may be any one of a wide variety of solid contact materials, and as representative examples of such materials, there may be mentioned: coke, carbon; in particular activated carbon, silica, alumina or other inorganic oxides, spent catalyst, naturally occurring clays, such as pumice, bauxite, fullers earth, etc.

A preferred contact material is coke in that after being used as a contact material, the coke, including deposited arsenic, may be used as the fuel supply for heating the deposited arsenic and added iron compound to a temperature at which the iron and arsenic combine, as hereinabove described. Thus, by combusting the coke, including deposited arsenic, in the presence of added iron compound, the iron and arsenic combine as hereinabove described. The use of coke as the solid contact material offers the further advantage that the coke can be produced on-site from the treated hydrocarbon material, whereby the process is self sufficient as to the contact material.

The coke which is employed for such pretreating may be any one of a wide variety of cokes which are available in the art. Although any one of a wide variety of cokes is suitable for the purposes of arsenic removal, improved results are obtained by employing a coke which has a porosity of less than 0.3 cc per gram, most generally less than 0.2 cc per gram, and in most cases less than 0.1 cc per gram.

The preferred coke has a surface area of less than 5 meter square per gram, generally less than 3 meter square per gram and most generally less than 2 meter square per gram.

The preferred coke has an average pore diameter of greater than 1,000 Å., with the average pore diameter being defined as follows:

$$\text{Average pore diameter in Angstroms} = \frac{4 \times \text{Pore Volume cc/g} \times 10{,}000}{\text{Surface area, m}^2\text{/g}}$$

The preferred coke has a pore distribution in which at least 40%, and most generally 50 to 80% of the pores have a size greater than 10,000 Å; at least 60%, preferably 70 to 80% of the pores are of a size greater than 1,000 Å., and less than 20%, preferably less than 10% of the pores have a size of less than 100 Å.

In accordance with the invention, the contact material, e.g., coke may be impregnated with an iron compound either prior to use thereof for arsenic removal or subsequent to use for arsenic removal and prior to the combustion. The coke may be impregnated with the iron compound by procedures known in the art; e.g., by the use of a water solution or slurry of the iron compound, followed by drying and calcining.

In accordance with a preferred embodiment of the invention, the coke which is employed for arsenic removal may be produced by delayed coking at the same site where the pretreating procedure is applied.

In accordance with the invention, the coke, which contains deposited arsenic, and which further includes the iron compound, may be burned in a manner such as to recover the fuel values of the coke. Thus, for example, the coke may be employed in a furnace for the plant to provide heating requirements therefor. Subsequent to the combustion, the arsenic containing residue, which is comprised of an iron-arsenic compound, as hereinabove described, may be removed and buried and such arsenic-containing compound does not present a potential health hazard.

The invention will be further described with respect to a preferred embodiment thereof illustrated in the accompanying drawing, wherein:

The drawing is a simplified schematic flow diagram of an embodiment of the present invention.

It is to be understood, however, that the present invention is not to be limited to the embodiment described with respect to the drawing.

Referring to the drawing, a hydrocarbon containing feed, which contains arsenic as an impurity, such as shale oil, which may contain from 30 to 50 ppm of arsenic, in line 10 is introduced into a pretreating zone, schematically generally indicated as 11, along with a hydrogen containing gas in line 12. The pretreating zone 11 includes a contact material and in particular coke, as hereinabove described, and is operated to effect removal of arsenic impurity, with the arsenic impurity being deposited on the coke.

The pretreated feed is withdrawn from zone 11 through line 13 and introduced into a hydrotreating zone, schematically generally indicated as 14, along with hydrogen containing gas in line 15. In accordance with a preferred procedure, the hydrotreating zone 14 is a zone designed and operated to effect upgrading of the hydrocarbon feedstock to lower boiling materials. In particular, such zone is operated at a temperature in the order of from about 650° F. to about 900° F., and a pressure in the order of from about 750 to about 2500 psig. The hydrotreating zone includes a suitable catalyst, such as nickel molybdate on alumina, tungsten nickel sulfide on alumina, or the like. The hydrotreating zone 14 is preferably an ebullated bed type of hydrotreating zone as described in U.S. Pat. No. RE 25,770. As a result of the arsenic removal effected in zone 11, the catalyst employed in hydrotreating zone 14 remains active for longer periods of time.

Hydrotreated product, including excess hydrogen, hydrogen sulfide and ammonia formed, light hydrocarbons, naphtha and heavier material is withdrawn from hydrotreating zone 14 through line 16.

In accordance with the present invention, periodically, coke having arsenic impurity deposited thereon, is withdrawn from zone 11 through line 17 for subsequent combustion as hereinabove described. If the coke does not include an iron compound, the coke is treated in zone 18 in order to provide the coke with an iron compound, as hereinabove described, prior to combustion thereof. The coke including the arsenic and iron compound is introduced into combustion zone 19 wherein the coke is burned to provide heat to generate steam for the plant. In this manner, arsenic deposited on the coke is converted to an iron-arsenic compound as hereinabove described which does not create a potential health hazard and which can be removed through line 20 for disposal; e.g., by burying thereof. Coke employed in zone 11 can be generated in the plant by delayed coking procedures generally known in the art, with the coke production zone schematically generally being indicated as 21. The feed to the coke production zone may be a portion of the feedstock introduced through line 22 and/or a heavy residue recovered as distillation bottoms from the hydrotreating step and introduced through line 23. The coke recovered from the coke production zone 21 after proper sizing and calcination may be introduced into arsenic removal zone 11 through line 24. In this manner, the overall plant is self-sufficient as to the coke.

The coke, prior to being used in zone 11, may be impregnated with an iron salt, such as ferrous sulfate, in zone 18, instead of effecting such treatment subsequent to arsenic removal and prior to combustion.

Although the embodiment has been described with particular reference to the use of coke as a solid contact material, it is to be understood that other contact materials may be employed.

The present invention is particularly advantageous in that it permits pretreating of a hydrocarbon feedstock which contains arsenic as an impurity, to effectively remove such arsenic and eliminate the problems caused by the arsenic in subsequent hydrotreating zones. In general, arsenic impurity is reduced to less than 2 ppm. In addition, the potential health hazard problems encountered in disposing of arsenic impurity can be eliminated. By proceeding in accordance with the invention, it is possible to dispose of the arsenic-containing impurity as a non-volatile, chemically stable, water insoluble iron arsenic compound which can be buried without providing health hazard problems. In accordance with the preferred aspects, such arsenic iron compound is in the form of a naturally occurring "ore."

Numerous modifications and variations of the present invention are possible in light of the above teachings and, therefore, within the scope of the appended claims, the invention may be practiced otherwise than as particularly described.

We claim:

1. In a process for removing arsenic from a hydrocarbon containing feed including arsenic as an impurity by depositing arsenic impurity on a solid contact material, the improvement comprising:

heating said contact material including deposited arsenic in the presence of an iron compound added to the contact material, said iron compound being a compound which reacts with arsenic to produce an iron-arsenic compound suitable for disposal, said heating being to a temperature of at least 1200° F. and at which the iron compound reacts with the deposited arsenic to produce said iron-arsenic compound.

2. The process of claim 1 wherein the feed is a shale oil or shale oil residue.

3. The process of claim 1 wherein heating is to a temperature of from 1200° F. to 2000° F.

4. The process of claim 3 wherein the contact material is coke.

5. The process of claim 4 wherein the coke has a porosity of less than 0.3 cc per gram, a surface area of less than 5 $m^2/g$., and a pore distribution wherein at least 40% of the pores have a size greater than 10,000 Å., at least 60% of the pores have a size greater than 1000 Å. and less than 20% of the pores have a size of less than 100 Å.

6. The process of claim 3 wherein the iron compound is at least one member selected from the group consisting of ferric hydroxide, ferrous sulfate, ferric nitrate and ferric chloride.

7. The process of claim 6 wherein the iron-arsenic compound is at least one of ferrous arsenide, ferrous arsenous sulfide and iron arsenate.

8. The process of claim 1 wherein the contact material is impregnated with the iron compound prior to contacting the feed for arsenic removal.

9. The process of claim 1 wherein the contact material is impregnated with the iron compound subsequent to contacting the feed for arsenic removal.

10. The process of claim 4 wherein the coke having deposited arsenic is heated by combustion of the coke.

* * * * *